US011359861B2

(12) United States Patent
Ganguly et al.

(10) Patent No.: US 11,359,861 B2
(45) Date of Patent: Jun. 14, 2022

(54) FREEZE DRYING PROCESS AND EQUIPMENT HEALTH MONITORING

(71) Applicant: IMA LIFE NORTH AMERICA INC., Tonawanda, NY (US)

(72) Inventors: Arnab Ganguly, Williamsville, NY (US); Ernesto Renzi, Youngstown, NY (US); Francis W. Demarco, Niagara Falls, NY (US); Ivan H. Lanaway, Newfane, NY (US); Vaibhav Kshirsagar, Amherst, NY (US)

(73) Assignee: IMA LIFE NORTH AMERICA INC., Tonawanda, NY (US)

( * ) Notice: Subject to any disclaimer, the term of this patent is extended or adjusted under 35 U.S.C. 154(b) by 67 days.

(21) Appl. No.: 17/043,263

(22) PCT Filed: Apr. 9, 2019

(86) PCT No.: PCT/US2019/026429
§ 371 (c)(1),
(2) Date: Sep. 29, 2020

(87) PCT Pub. No.: WO2019/199710
PCT Pub. Date: Oct. 17, 2019

(65) Prior Publication Data

US 2021/0018264 A1 Jan. 21, 2021

Related U.S. Application Data

(60) Provisional application No. 62/655,295, filed on Apr. 10, 2018.

(51) Int. Cl.

| | |
|---|---|
| ***F26B 5/06*** | (2006.01) |
| ***F26B 21/10*** | (2006.01) |
| ***F26B 25/22*** | (2006.01) |

(52) U.S. Cl.
CPC ..... *F26B 5/06* (2013.01); *F26B 21/10* (2013.01); *F26B 25/22* (2013.01)

(58) Field of Classification Search
CPC ..... F26B 5/06; F26B 21/10; F26B 25/22
(Continued)

(56) References Cited

U.S. PATENT DOCUMENTS 6,102,665 A 8/2000 Centers
6,163,979 A 12/2000 Oetjen et al.
(Continued)

FOREIGN PATENT DOCUMENTS

CN 2760478 Y 2/2006
CN 2824105 Y 10/2006
(Continued)

OTHER PUBLICATIONS

Patel et al., Determination of End Point of Primary Drying in Freeze-Drying Process Control. AAPS PharmSciTech, vol. 11, No. 1. Mar. 2010 (#2009). [retrieved on Mar. 6, 2019], Retrieved from the Internet: <URL: https://www.ncbi.nlm.nih.gov/pmc/articles/PMC2850457/> entire document.
(Continued)

*Primary Examiner* — Stephen M Gravini
(74) *Attorney, Agent, or Firm* — Luccarelli & Musacchio LLP; Pasquale Musacchio

(57) ABSTRACT

In a system and method for controlling a freeze drying process, a diagnostics server (718) is connected for receiving time series data from a freeze drying system (710, 711). The diagnostics server uses a tuned freeze drying system mathematical model to analyze the time series data to predict a system event, and alter the freeze drying process. An analytics server (730) is connected for secure communication with the diagnostics server, and creates and tunes the freeze drying system mathematical model. An equipment provider
(Continued)

service and diagnostic cloud (735) may apply learning algorithms to the time series data to enhance diagnostic tools and provide predictive maintenance and diagnostic services to the operator of the first production sites using the diagnostic tools.

27 Claims, 9 Drawing Sheets

(58) Field of Classification Search
USPC ..... 34/287
See application file for complete search history.

(56) References Cited

U.S. PATENT DOCUMENTS

| | | | | |
|---|---|---|---|---|
| 6,848,196 | B2 | 2/2005 | Brulls | |
| 6,931,754 | B2 * | 8/2005 | Sennhenn | F26B 5/06 34/92 |
| 6,971,187 | B1 | 12/2005 | Pikal et al. | |
| 8,793,895 | B2 * | 8/2014 | Gasteyer, III | A61P 31/12 34/287 |
| 8,800,162 | B2 * | 8/2014 | Velardi | F26B 5/06 34/298 |
| 9,651,305 | B2 * | 5/2017 | Gasteyer | F26B 5/06 |
| 9,879,909 | B2 * | 1/2018 | Fissore | F26B 5/06 |
| 9,945,611 | B2 * | 4/2018 | DeMarco | F26B 5/065 |
| 10,113,797 | B2 * | 10/2018 | Dern | F26B 9/066 |
| 10,465,985 | B2 * | 11/2019 | Ganguly | A23L 3/44 |
| 10,641,661 | B2 * | 5/2020 | Ganguly | G01K 1/024 |
| 10,782,070 | B2 * | 9/2020 | Dern | F25B 13/00 |
| 10,809,003 | B2 * | 10/2020 | De Beer | F26B 5/06 |
| 11,143,454 | B2 * | 10/2021 | Triglia, Jr. | F26B 25/22 |
| 2007/0156373 | A1 | 7/2007 | Yamashita | |
| 2008/0098614 | A1 | 5/2008 | Tchessalov et al. | |
| 2010/0107436 | A1 | 5/2010 | Velardi | |
| 2013/0006546 | A1 | 1/2013 | Fissore | |
| 2015/0007445 | A1 | 1/2015 | Gebhard et al. | |
| 2015/0106912 | A1 | 4/2015 | Brandon | |
| 2015/0226617 | A1 | 8/2015 | Thompson et al. | |
| 2021/0018264 | A1 * | 1/2021 | Ganguly | F26B 21/10 |

FOREIGN PATENT DOCUMENTS

| | | | | |
|---|---|---|---|---|
| CN | 101403565 | A | 4/2009 | |
| CN | 201327249 | Y | 10/2009 | |
| CN | 204086931 | U | 1/2015 | |
| CN | 205482118 | U | 8/2017 | |
| CN | 206622130 | U | 11/2017 | |
| EP | 2148158 | A1 | 1/2010 | |
| JP | 6194923 | B2 | 9/2017 | |
| WO | 1995030118 | A1 | 11/1995 | |
| WO | 0040910 | A1 | 7/2000 | |
| WO | 2014127379 | A1 | 8/2014 | |
| WO | 2016/191799 | A1 | 12/2016 | |
| WO | WO-2018033468 | A1 * | 2/2018 | F26B 21/10 |
| WO | WO-2019199710 | A1 * | 10/2019 | F26B 21/10 |

OTHER PUBLICATIONS

Rockwell Automation Remote Monitoring and Analytics—Secure remote access and monitoring for your critical assets, www.rockwellautomation.com Publication GMSP-PP004D-EN-P Oct. 2016.

EWON-compressor systems—Remote Management helps BAUER improve customer care and service management. Retrieved from the Internet URL: https://cdn.hms-networks.com/docs/default-source/netbiter-english/case-studies/netbiter-case-study—bauer-usa.pdf?sfvrsn=7056c7d6_10.

Mail et al., Recommended Best Practices for Process Monitoring Instrumentation in Pharmaceutical Freeze Drying—2017. AAPS PharmaSciTech, vol. 18, No. 7, Oct. 2017.

Ganguly et al., Freeze-drying simulation framework coupling product attributes and equipment capability: Toward accelerating process by equipment modifications. 85 European Journal of Pharmaceutics and Biopharmaceutics 223-235 (2013).

Supplementary EP Search Report dated Nov. 3, 2021 for counterpart EP Application No. EP19785309.

CN Search Report dated Oct. 29, 2021 for counterpart CN Application No. CN20198025091.5.

* cited by examiner

600

FREEZE DRYING PROCESS AND EQUIPMENT HEALTH MONITORING

FIELD OF THE INVENTION

The present disclosure generally relates to freeze drying equipment and processes that use such equipment to freeze dry a product. More particularly, the disclosure relates to systems and methods for monitoring a freeze drying system. The disclosure includes the creation of a statistical model that uses engineering input together with an analysis of historical key performance indicator time series. The statistical model is designed to predict failures and other events in a freeze drying system. The statistical model may be tuned for use with a particular freeze drying system installation using data gathered from that installation. The particular freeze drying system installation is then monitored in real time using the tuned statistical model.

BACKGROUND

Freeze drying is a process that removes a solvent or suspension medium, typically water, from a product. Freeze-drying is a low-pressure, low-temperature condensation pumping process widely used in the manufacture of pharmaceuticals for removal of solvents by sublimation. In a freeze drying process for removing water, the water in the product is frozen to form ice and, under vacuum, the ice is sublimed and the vapor flows to a condenser. The water vapor is condensed in the condenser as ice and is later removed from the condenser. Freeze drying is particularly useful in the pharmaceutical industry, as the integrity of the product is preserved during the freeze drying process and product stability can be guaranteed over relatively long periods of time. The freeze dried product is ordinarily, but not necessarily, a biological substance.

Pharmaceutical freeze drying is often an aseptic process that requires sterile conditions within the freezing and drying chambers. It is critical to assure that all components of the freeze drying system coming into contact with the product are sterile.

Typical freeze drying processes used in the pharmaceutical industry process either bulk product or product contained in vials. In an example of a bulk freeze drying system 100 shown in FIG. 1, a batch of bulk product 112 is placed in freeze dryer trays 121 within a freeze drying chamber 110. Freeze dryer shelves 123 are used to support the trays 121 and to transfer heat to and from the trays and the product as required by the process. Alternatively, product containment vials containing the product are placed on the shelves. A heat transfer fluid flowing through conduits within the shelves 123 may be used to remove or add heat.

Under vacuum, the frozen product 112 is heated slightly using the heat transfer fluid flowing through conduits in the shelves to cause sublimation of the ice within the product. Water vapor resulting from the sublimation of the ice flows through a passageway 115 into a condensing chamber 120 containing condensing coils or other surfaces 122 maintained below the condensation temperature of the water vapor. A coolant is passed through the coils 122 to remove heat, causing the water vapor to condense as ice on the coils.

Both the freeze drying chamber 110 and the condensing chamber 120 are maintained under vacuum during the process by a vacuum pump 150 connected to the exhaust of the condensing chamber 120. Non-condensable gases contained in the chambers 110, 120 are removed by the vacuum pump 150 and exhausted at a higher pressure outlet 152.

A typical freeze dryer cycles through large local thermal stresses with operating temperatures ranging from −50° C. to 121° C. and pressures ranging from 10 Pa to 0.2 MPa. Based on ASME section VIII, localized fatigue damage ratio can be as high as 20% with up to 5000 operating cycles. Moreover, the shelves of a freeze dryer move during clean-in-place/sterilize-in-place cycles, loading/unloading and stoppering of vials. In addition, service life of these machines can sometimes exceed 3 decades. Coupled with the value of the products manufactured in each batch, which can sometimes be in excess of several million US dollars, testing product integrity is of paramount importance. At the heart of this requirement lies the need for real-time testing of the health of the freeze dryer. The present disclosure deals with replacing the current state of the art, where equipment preventive maintenance is performed on a pre-defined schedule, with real-time health monitoring with multiple deployed sensors for tracking signatures to failure with built-in redundancy.

Despite the long life of a typical freeze dryer and the high value of in-process batches, the condition of the equipment in current systems is monitored only through preventative maintenance plans and pre-defined inspection programs, with little scientific rationale for the schedule. Manufacturing companies therefore often use a very conservative maintenance program, which may cost a typical company very high downtime. For example, if the total downtime in schedule for the year is 33%, a typical operation may suffer in maximum throughput. On the other hand, a lean maintenance program may lead to excursions, batches held from release, delays or even rejection, costing several batches worth of product.

SUMMARY

A method is disclosed for controlling a target freeze drying system. The method includes receiving time series data from a plurality of sensors arranged on the target freeze drying system; tuning a general freeze drying system mathematical model using the time series data to adjust parameters of the general freeze drying system mathematical model to create a tuned freeze drying system mathematical model representing the target freeze drying system; receiving monitoring data from the plurality of sensors; predicting a system event of the target freeze drying system using the tuned freeze drying system mathematical model to analyze the monitoring data; and, based on the predicting the system event of the target freeze drying system, altering a freeze drying process being performed by the target freeze drying system.

In addition, a monitoring system is disclosed for a freeze drying system. The system comprises a first diagnostics server (718) connected for receiving time series data through a local area network (717) from a plurality of sensors arranged on a first freeze drying system (710, 711), the first diagnostics server and the first freeze drying system being co-located in a first production location (715), the first diagnostics server comprising a processor and a computer readable storage device having computer readable instructions stored thereon that, when executed by the processor, cause the first diagnostics server to perform the following operations: (a) receiving a first sequence of time series data from the plurality of sensors through the local area network; (b) providing the first sequence of time series data to a data analytics function (720) for tuning a general freeze drying system mathematical model by adjusting parameters of the general freeze drying system mathematical model to create a tuned freeze drying system mathematical model representing the first freeze drying system; (c) receiving a second sequence of time series data from the plurality of sensors through the local area network; (d) predicting a system event of the first freeze drying system using the tuned freeze drying system mathematical model to analyze the second sequence of time series data; and (e) based on the predicting the system event of the first freeze drying system, altering a freeze drying process being performed by the first freeze drying system.

Those skilled in the art may apply the respective features of the present invention jointly or severally in any combination or sub-combination.

BRIEF DESCRIPTION OF DRAWINGS

The exemplary embodiments of the invention are further described in the following detailed description in conjunction with the accompanying drawings, in which.

DESCRIPTION

Figure 1:
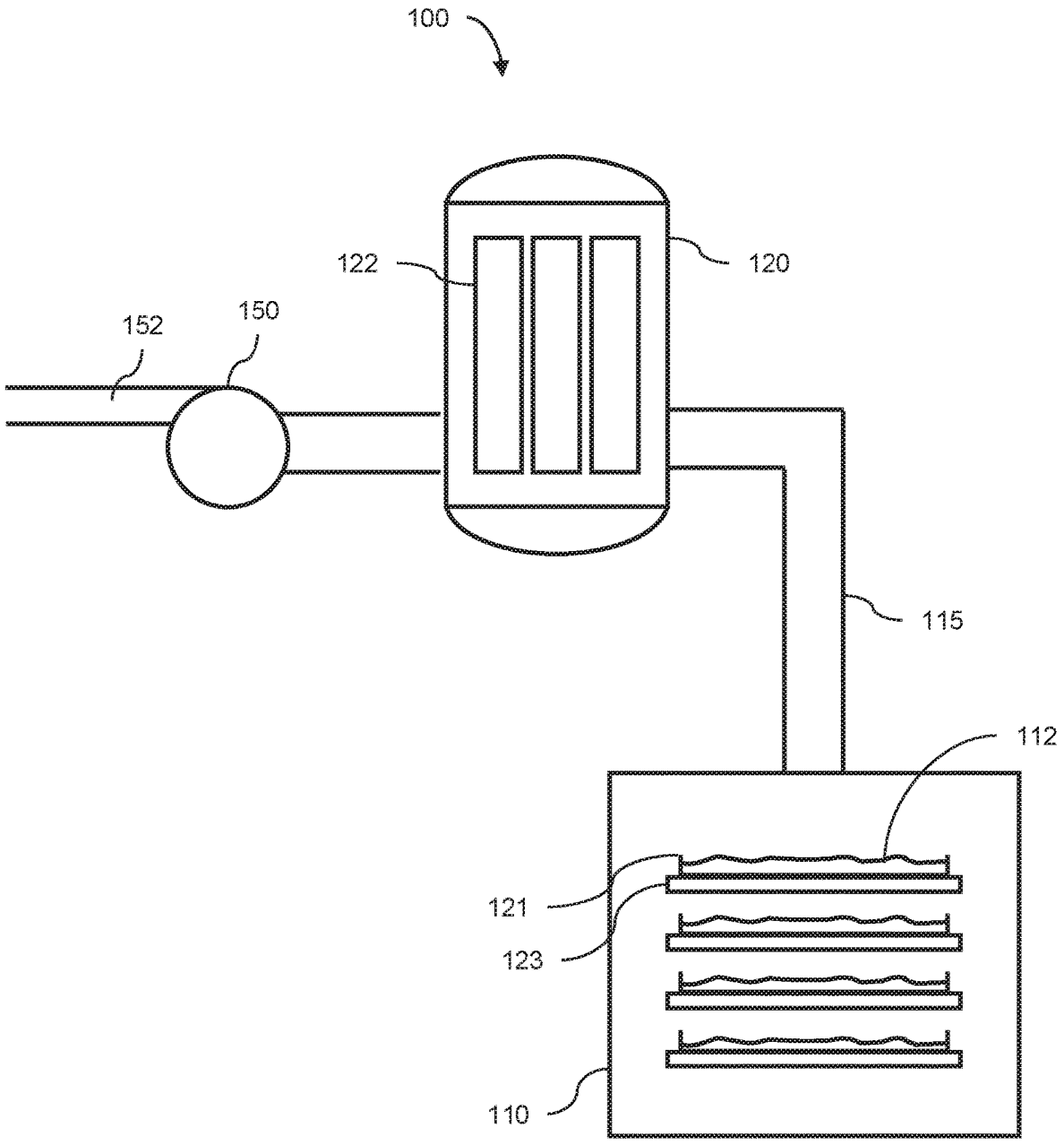
Fig. 1 prior art
FIG. 1 depicts a conventional freeze drying system.

The presently disclosed technique monitors a freeze drying system by analyzing measurements from sensors or instruments deployed in a freeze dryer or its ancillary equipment. The sensors, individually or in combination, measure time series that may reflect signatures to failure of a manufacturing or laboratory process or of critical components of the freeze dryer or any other pharmaceutical equipment. The technique may apply algorithms to the measured parameters to perform real-time analysis and detect signatures to failure. Use of the presently disclosed technique reduces downtime for batch production and also reduces the need for redundancy in maintenance operations. In a laboratory environment, the technique may further be used in the development of new or improved freeze drying equipment and processes.

The disclosed technique may collect data and/or predict events in one or more of three areas of interest in a freeze drying system: the system equipment, the process parameters and the intermediate and/or end products. Time series data may be collected from any of those areas of interest, and the technique may predict system events in the same area of interest from which the data is collected, or may predict system events in another area of interest. A system event is an event affecting one or more of the system equipment, the process parameters and the intermediate and/or end products For example, in the system equipment area of interest, critical systems in a functioning freeze dryer include a refrigeration system and a hydraulic system. The refrigeration system requires regular human intervention today for monitoring various parameters that include the refrigerant charge volume, contamination, discharge temperature and cooling water temperature on inlet and outlet, and vibration. Similarly, on the hydraulic system, monitoring includes oil temperature, oil levels and system pressure. Quite often, to avoid complexity and logistics associated with monitoring, redundancies are built into the system. In the presently disclosed monitoring system, typical signatures to failure are read using sensors and analyzed real-time through algorithms located on a server that may be remote. Moreover, the communication takes into account data privacy requirements by using only access points based on authentication requests set up from the customer, if required.

The following are some exemplary sensor types and the parameters that are monitored by those sensor types in a typical freeze drying system. Each parameter may have its own characteristic signature to failure, alone or in combination with other sensors. The examples include sensor types that may be used in measuring parameters that may affect any of the three areas of interest in a freeze drying system: the system equipment, the process parameters and the intermediate and/or end products.

Pressure gauges include a discharge pressure switch and transducer, suction pressure switch, oil filter pressure switch and transducer, water supply pressure switch and transducer, oil cooler water supply pressure switch and transducer, motor water supply pressure switch and transducer, liquid line filter outlet pressure transducer, shelf flow cooler refrigerant outlet pressure transducer, and condenser coil or flow cooler refrigerant outlet pressure transducer.

Temperature gauges are used for monitoring compressor suction temperature, shelf flow cooler refrigerant outlet temperature, condenser coil or flow cooler refrigerant outlet temperature, oil cooler temperature, oil outlet temperature, water condenser refrigerant outlet temperature, and refrigerant sub cooler refrigerant outlet temperature.

Flow sensors include water condenser cooling water flow switch, water condenser cooling water flow meter, motor jacket cooling water flow switch, motor jacket cooling water flow meter, oil cooler water flow switch, oil cooler water flow meter, and refrigerant sight glass flow monitoring.

Vibration gauges such as accelerometers, velocity transducers and displacement gauges are used in measuring compressor and vacuum pump vibration.

Power meters measure the three-phase power drawn by compressors or vacuum pumps. A single power meter may be employed; alternatively, separate voltage and current sensors may be used.

Level sensors and switches monitor water condenser refrigerant level, suction accumulator level and compressor oil level.

An infrared laser sensor or another imaging/appearance sensor may be used in evaluating the presence of residual moisture or the presence of contamination in the product. A near-infrared, infrared or x-ray sensor may be used to evaluate the integrity of the vial and stopper during and after the freeze drying process.

A mass spectrometer may be used in analyzing gases present during the freeze drying process. For example, gases in a vacuum drying chamber may be analyzed to measure residual moisture content during the drying stages, to detect heat transfer fluid leaks and to detect leaks from atmosphere.

Predicting System Failures

For each freeze dryer system, threshold values are determined for the group of key performance indicators that indicate an imminent failure for the freeze dryer process or system. The key performance indicators of the freeze dryer system are then monitored in real time, and the freeze dryer system is placed in a product saving mode (or a maintenance mode if between production batches) when a key performance indicator exceeds a threshold value.

Commercial freeze dryers for use in the pharmaceutical industry are typically custom designed for processing a single product or a group of products according to the specifications of a customer. For that reason, commercial freeze dryers such as those installed in pharmaceutical manufacturing facilities vary widely in design and configuration. Similar installations are unusual. Individual commercial freeze dryers typically have a unique chamber volume and configuration, materials handling elements, vacuum pumping system and refrigeration equipment.

Despite the variability among installations, however, basic relationships exist between freeze dryer system failure modes and characteristic signatures of the sensor data. Those basic relationships may be identified by analyzing historical time series measurements taken with sensors such as the sensors described above, from a single system or from multiple systems installed in multiple pharmaceutical manufacturing facilities. The identified relationships may involve individual sensor readings, time functions of the sensor readings, combinations of two or more different sensor readings, etc.

Data analysis techniques may be used to identify the characteristics correlating to events such as system failures. Those data analysis techniques may include regression analysis methods, data correlation analysis, etc. The historical time series measurements may be manually labeled at points in time where significant events such as failures occur. Alternatively, those significant events may be determined during analysis using the historical time series data itself. For example, the occurrence of a choke flow failure (described below) may be identified by a sudden increase in a pressure sensor measurement in the freeze drying chamber. Data analysis techniques may then be used to identify other sensors that predict the occurrence of the choke flow failure.

Human expert knowledge from past experience may additionally or alternatively be used to identify patterns and relationships in sensor reading time series that may predict a failure.

A generic statistical model may be created from the historical time series measurements in order to determine probabilities of various failure modes based on a set of measured sensor time series.

For the identified relationships between freeze dryer system failure modes and characteristic signatures of the sensor data, rules governing the prediction of a failure for a particular freeze dryer system may be created using measurement data from that particular system. It has been found that, although the basic, generic relationships are valid across most systems, individual rules that include unique thresholds and other parameters must be created for each unique freeze dryer system. The unique thresholds and other parameters are determined by applying data analytics methods to data from the unique freeze dryer system, using the basic, generic relationships. Those data analytic methods may be applied to the data by a server at a remote location such as in the cloud, or by a server at the equipment builder facility. Alternatively, the data analytics methods may be applied by computing resources on-site at the facility where the freeze dryer system is installed. The data analytics methods tune the generic statistical model for use with a unique freeze drying system.

The data analytics methods may be applied automatically upon system start-up, either at the machine builder facility before shipment or at the customer. Conservative thresholds and other values may initially be used with the generic statistical model in monitoring a particular system. Machine learning techniques may then be used to tune or adapt the generic rules to accurately represent the particular system.

The particular system is then monitored, using the tuned rules to predict process/system failures and provide sufficient advance warning to take measures to protect the product. For example, the process may be halted and the freeze drying system may be placed in a product protection mode in which the product is maintained under conditions selected to preserve the product until the process is restarted. The product protection mode conditions may be selected in real time based on process conditions at the time of the failure or shut-down.

The following examples are presented as illustrations of the above-described techniques. Other implementations, as applied to other characteristics of freeze drying systems and other technologies, are possible.

Example: Predicting Choked Flow

Freeze dryer process choking is a process failure mode in which the freeze dryer is overloaded and unable to maintain vacuum in the process chamber. Choking may result from an overly aggressive process cycle in which too much product or product containing a very high moisture content is placed in the chamber for drying, or heat is added to the product at an aggressive rate, resulting in sublimation of moisture at a rate too high for the vacuum pump to handle.

Process choking can result in a deviation of the target vacuum pressure in the chamber (e.g., 8 Pa), leading to the loss of an entire batch of product. If the onset of process choking is detected early enough, then it is possible to place the process in a product protection mode, in which the shelf temperature is rapidly reduced, removing heat from the product and reducing the rate of sublimation. It has been found that neither a direct measurement of vacuum pressure in the process chamber, nor a detection of a vacuum pump failure, provide a sufficiently early warning of choked flow, and it is frequently not possible to place the system in product protection mode before the entire batch is lost.

Figure 2:
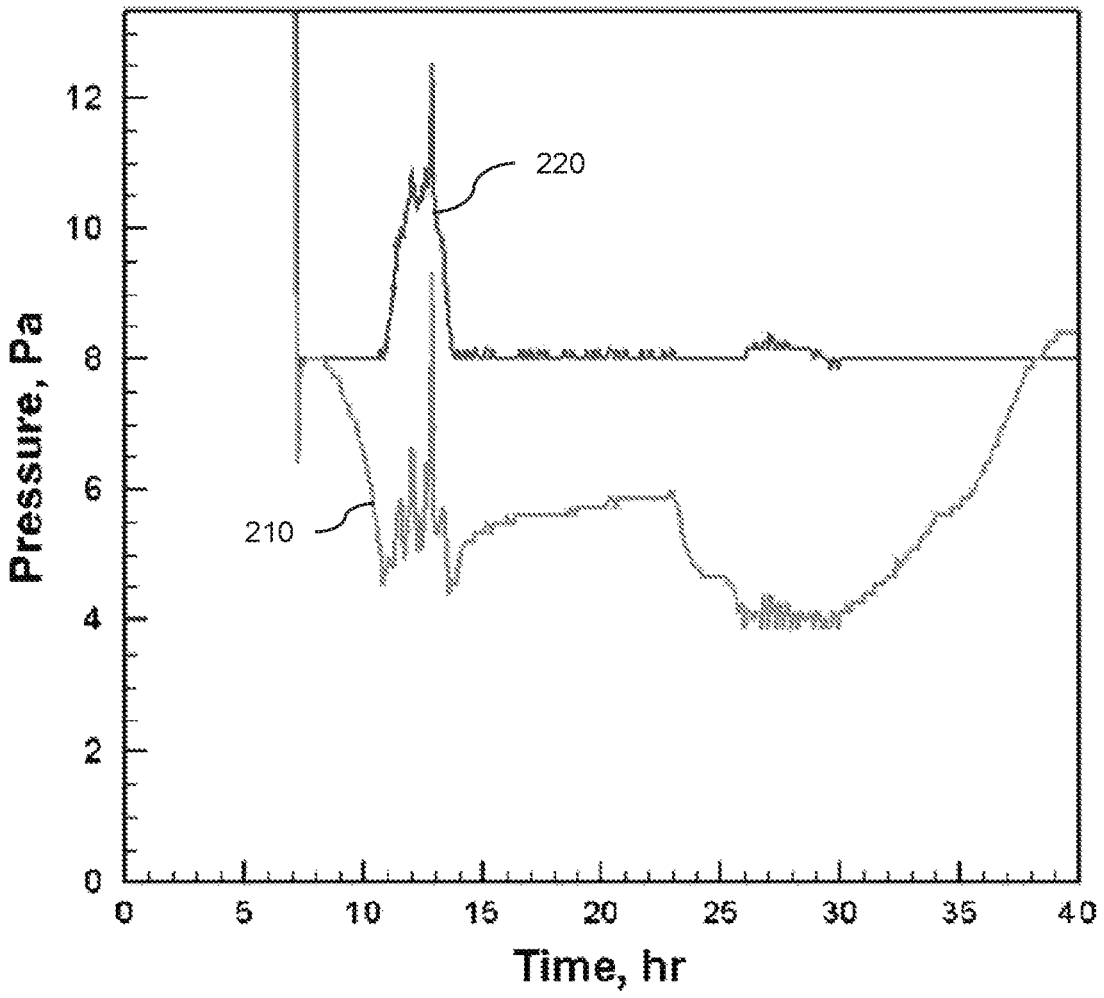
FIG. 2 is a graphical representation of an actual time series of pressure for a vacuum chamber and a condenser chamber in a bulk freeze drying system.

Several data signatures have been identified as being helpful in predicting a choked flow in sufficient time to place the system in product protection mode. As shown in FIG. 2, a rapid drop 210 in pressure in the condenser (element 120 in FIG. 1) takes place before the increase 220 in pressure in the vacuum chamber 110 that is caused by choking of the vacuum pump.

By monitoring the time function of condenser pressure and detecting the rapid decrease 210 in pressure, the disclosed system can predict a choking event and place the system in product protection mode before the pressure increases above set point in the vacuum chamber, thereby saving the batch.

The unique parameters for predicting a choke flow event in a particular freeze dryer system are dependent on the particular configuration of that freeze dryer system. Those unique parameters may be determined by applying data analytical techniques to time series data measured on the particular system. For example, a characteristic threshold condenser pressure drop, or a characteristic threshold slope of a condenser pressure time series, may be learned by analyzing time series data from that system. In one instance, a slope threshold was found to be 0.2 μbar/min. Product protection mode may be entered upon exceeding one or more of those thresholds, before choked flow actually occurs.

Another parameter found to be useful in predicting a choked flow is the rate of nitrogen bleed into the vacuum chamber. Sterile nitrogen gas is bled into the vacuum chamber as a means of controlling vacuum chamber pressure while operating the vacuum pump at a constant speed. A rate of nitrogen bleed into the vacuum chamber may be measured as a function of percent bleed valve opening. If the rate of nitrogen bleed into the vacuum chamber drops substantially, it may be an indication that there is too much moisture in the chamber and that system choking is imminent. While that characteristic may be used in many systems to predict process choking, the actual threshold value of nitrogen bleed rate used in a particular system is determined by applying data analytics techniques to data from the particular system, and must be determined by performing data analytical techniques to time series data measured on the particular system.

Example: Detecting Cycle End Point

Figure 3:
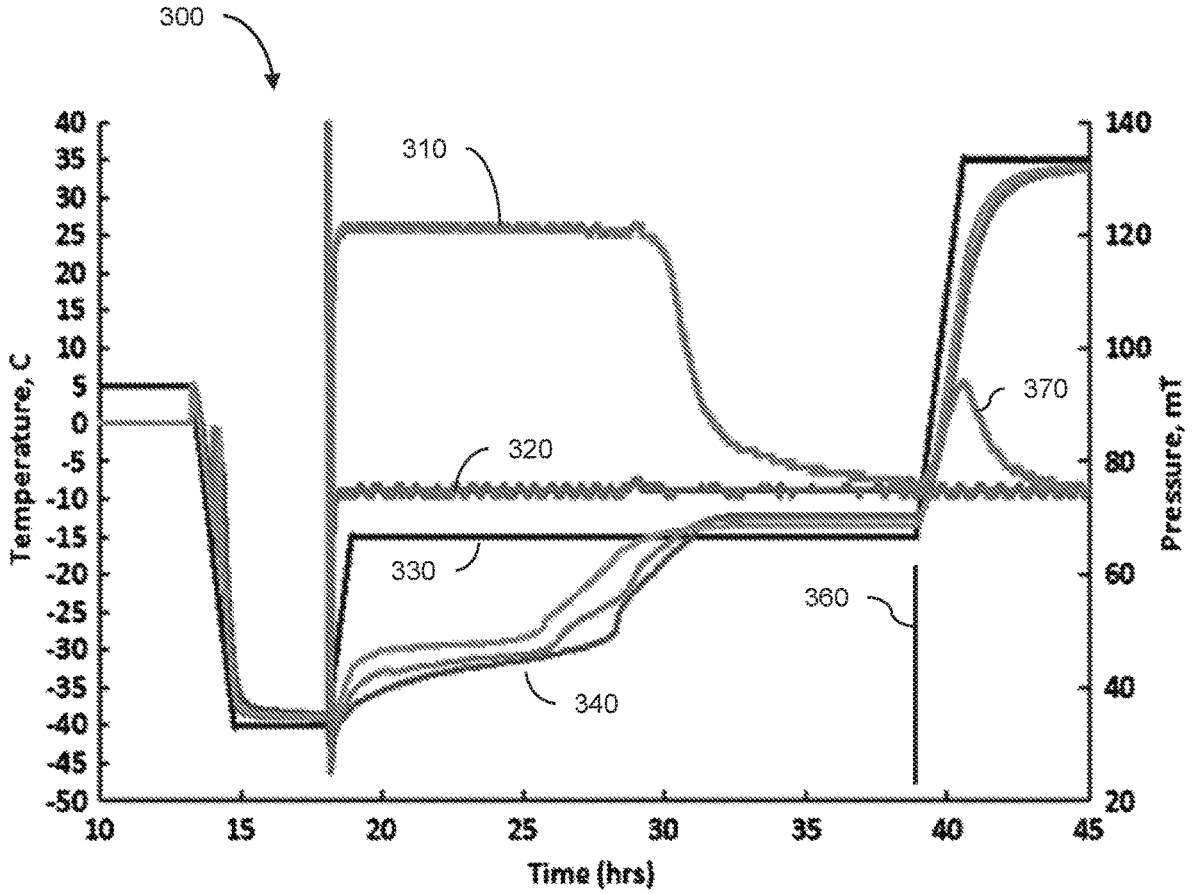
FIG. 3 is a graphical representation of several time series measurements made during a typical freeze dryer system process cycle.

Several time series measurements made during a typical freeze dryer system process cycle are shown in the chart 300 of FIG. 3. The trace 310 represents vacuum chamber pressure as measured by a Pirani gauge, which is a thermal-conductivity-type pressure gauge that is sensitive to the gas-phase composition inside the chamber. The trace 320 represents vacuum chamber pressure as measured by a capacitance manometer which measures true pressure independent of gas-phase composition. The trace 330 indicates shelf temperature in the chamber. The remaining traces 340 represent thermocouple measurements of individual product temperatures within the chamber, which can be seen to generally follow the shelf temperature 330.

During the initial drying phase, the shelf temperature 330 is held constant until moisture in the chamber drops, as indicated by the drop in the trace 310. The approach of the trace 310 to the trace 320 indicates that both pressure gauges are measuring the same pressures, indicating a low amount of gas-phase solvent in the chamber. At the time 360, shelf temperature is increased to complete the sublimation of solvent from the product. At that point in the cycle, the freeze dryer system is typically run for a long period of time to assure that all solvent is removed from the product. That conservative approach can greatly increase the effective cycle time, reducing the overall efficiency of the freeze dryer system.

After the shelf temperature is increased at time 360, the trace 310 again departs from the trace 320, forming a peak 370, indicating that additional solvent has sublimed from the product. The traces 310, 320 eventually rejoin, showing that there is substantially no solvent vapor in the chamber, which indicates that substantially no additional sublimation is taking place.

That rejoining of the two pressure measurements has been found to be a reliable indicator that the freeze drying process is complete. The determination of the end of the process eliminates the need to conservatively run the process for additional time to assure that the product is completely dry.

As with the detection of process choking discussed above, the specific thresholds and parameters used in determining the end of the process may be different for different freeze drying systems. Those parameters must be learned by the system by analyzing measurement traces from that particular system.

Example: Detecting Vacuum Pump Maintenance Issues

Figure 4:
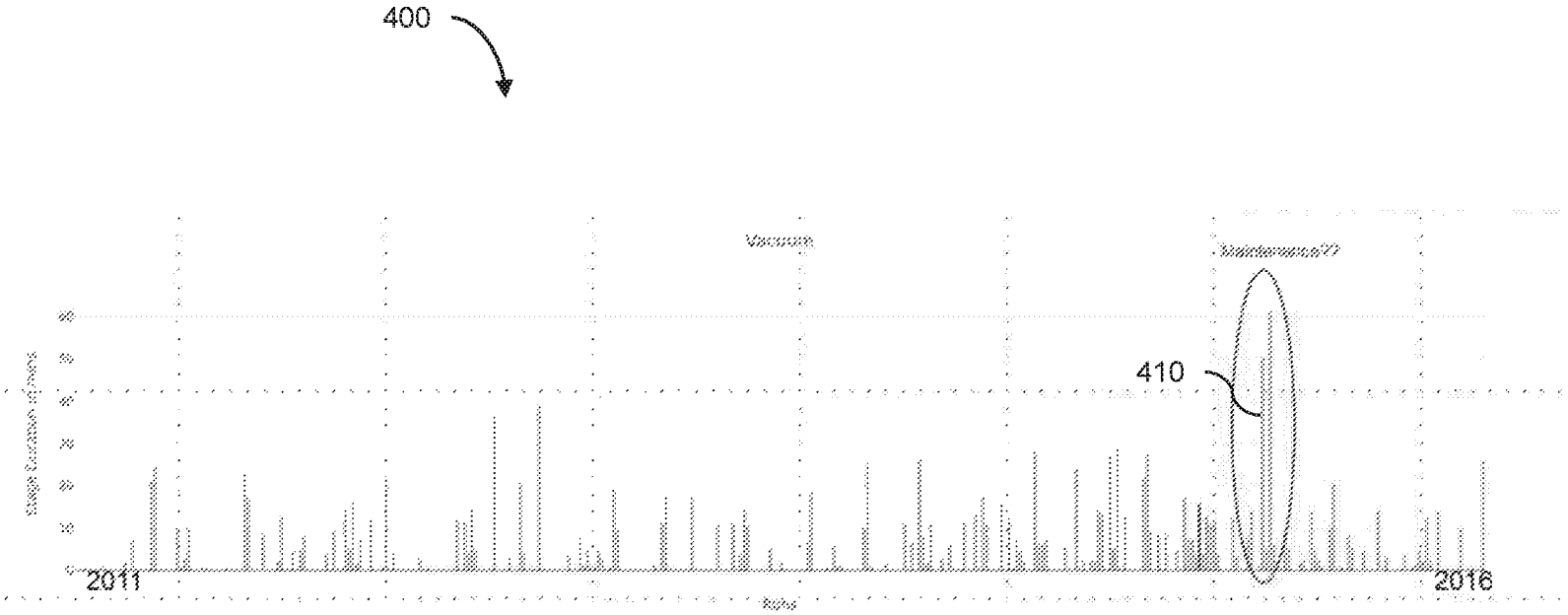
FIG. 4 is a bar chart representing freeze drying chamber pump-down times measured over a five year period.

During the freeze drying process, the vacuum pump must evacuate the drying chamber to a set-point vacuum pressure of, in one example, 8 Pa. The elapsed time from the pump start-up until reaching the set point has been found to be an indication of vacuum pump health. For example, in the bar chart 400 of FIG. 4, pump-down times are generally less than 30 minutes. In December, 2016, there were two occurrences of a pump-down time in excess of 40 minutes. It may be inferred that the vacuum pump at that time required maintenance, or some related equipment was failing.

While a pump-down time of more than 40 minutes may indicate a problem with the freeze drying system represented in the graph 400, that pump-down time may be normal for a freeze drying system having a larger chamber volume, a smaller vacuum pump, or another design characteristic that increases vacuum pump-down time. Although it is known that a longer-than-normal pump-down time is an indicator of a system problem, each unique freeze drying system must learn a threshold parameter that indicates that that unique system has a problem.

In addition to a threshold pump-down time over which an action is taken, the technique may additionally monitor a rate by which the pump-down time is increasing from cycle to cycle. A large change in pump-down time over only a few cycles may indicate a developing problem. As with the absolute pump-down time, the system learns a normal rate of change and a threshold rate over which action is taken.

Example: Refrigeration System Health

Figure 5:
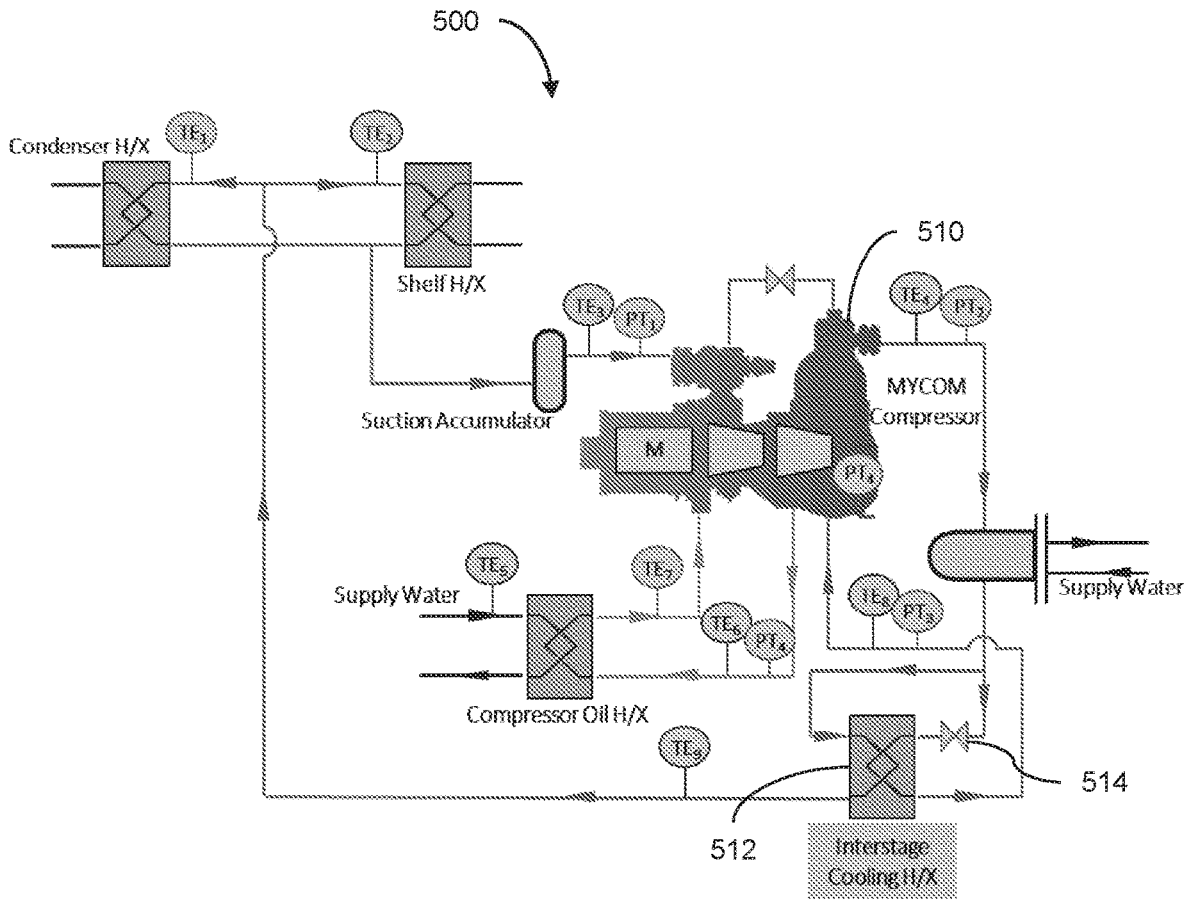
FIG. 5 is a schematic representation of a refrigeration system and associated sensors according to embodiments of the disclosure.

The refrigeration system of a freeze dryer typically includes several compressors, heat transfer fluid expansion tanks and piping, heat exchangers, filters and condensers. The operating temperatures and pressures of various components provide information on whether the assembly is operating as designed. As shown in the exemplary schematic diagram 500 shown in FIG. 5, temperature sensors $TE_1$-$TE_9$ and pressure sensors $PT_1$-$PT_4$ are arranged to measure various temperatures and pressures at inlets and outlets of components including a main compressor 510 and an interstage cooling heat exchanger 512.

In one example, the $TE_9$ temperature sensor following the interstage cooling heat exchanger 512 is monitored by the disclosed system to predict abnormal changes in the refrigerant, or loss in the refrigerant volume. That temperature measurement may also be used to predict failure of the expansion valve 514 feeding to the heat exchanger's inlet, which failure may be verified electrically.

A newly installed freeze drying system may automatically begin accumulating data from the $TE_9$ temperature sensor as well as data from other sensors indicative of the current health of the refrigeration system. Data analytics methods may automatically be applied to that data in order to determine thresholds and other parameters that are unique to the newly installed system. For example, a normal temperature range may be determined for the $TE_9$ temperature sensor, where a deviation from that range is predictive of a refrigeration system failure. Data analytics methods may also be used over the life of the freeze drying system to adjust the thresholds and other parameters for changes in the system, such as wear, repair, maintenance and replacement, as well as changes in the process itself, such as a change in the type of refrigerant or compressor oil used.

Values of temperatures or pressures trending towards the boundaries of the ideal range indicate worsening conditions in the refrigeration system. Those sets of conditions are built into the health monitoring system. Upon predicting a failure, the monitoring system generates appropriate alarms and places the product in a product protection mode.

In another example, the freeze dryer condenser cooling temperature and capacity is affected by low volumes of refrigerant. That lack of refrigerant affecting the freeze dryer performance can be detected by temperature and pressure sensors placed on the compressors in the refrigeration assembly. A lack in refrigerant will show deviations in temperature sensors TE4, TE8, TE3 and TE9 as well as the pressure transducers PT2, PT1 and PT3.

A high water temperature, a drop in water quality or a low water supply flow rate may all cause deviations in the oil temperature or compressor jacket temperature, which may lead to undesirable fluctuations in the heat transfer fluid temperatures. By monitoring the temperature of the water outlet from the compressor, detected abnormalities may indicate a blocked heat exchanger or oil filter, water supply issues caused by valve failures or fouling. Those abnormalities may be detected using pressure transducers or thermocouples in the water supply line.

Abnormalities in time functions of the sensor readings may also be monitored. For example, a threshold rate of increase or decrease may be applied to a sensor measurement of compressor water outlet temperature to predict a blocked heat exchanger.

The monitoring system may determine threshold values that define the abnormalities for an individual freeze drying installation. For example, data analytics methods may automatically be applied to data collected in a particular freeze drying system in order to determine thresholds and other parameters that are unique to that system. The thresholds and other parameters may furthermore be automatically adjusted over time to accommodate changes in the system.

Example: Use of Power Consumption Data and Vibration Data

Figure 6:
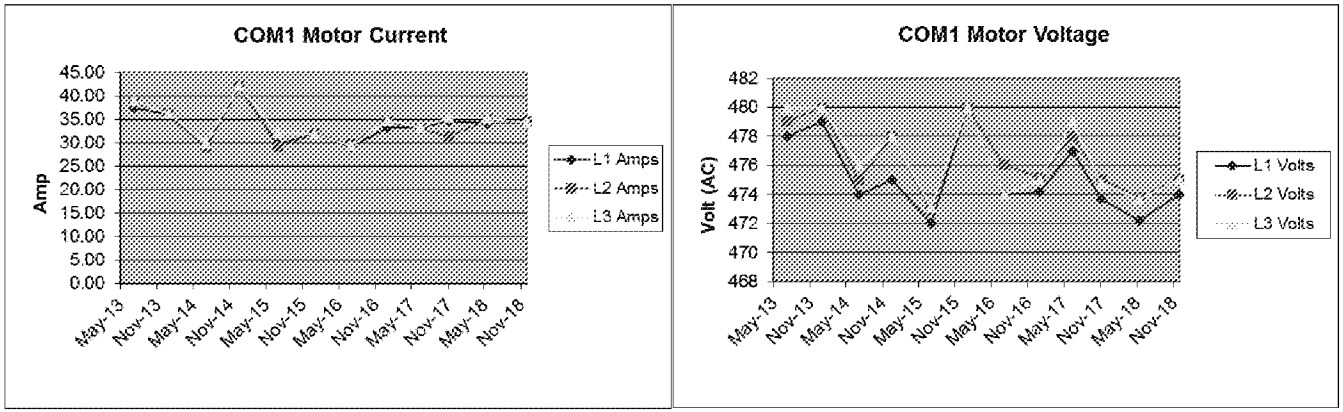
FIG. 6 is a graphical representation of voltage and current consumed by a compressor motor over time.

Power meters for monitoring three-phase voltage and current are permanently mounted on rotating equipment such as compressors and pumps. The voltage and current data are related, i.e as the voltage increases, the current requirement decreases, thus keeping the power load of the component constant. An example graph 600, shown in FIG. 6, shows current and voltage consumption data for a typical motor. The power draw of certain components in a freeze drying system depends upon the stage the system currently is in—startup, freezing or drying. The power meters capture anomalies, where the load requirements increase or decrease more than normal for a particular stage. For example, for a compressor, increased power consumption may be an indicator of loss in oil quality or particulates in the oil.

Because power consumption varies with the stage of the freeze drying cycle, the data analytics methods may automatically compute separate power consumption thresholds and other parameters for each stage of the freeze drying cycle. The thresholds may be computed as a time function that is correlated with the process cycle. For example, power consumption for the vacuum pump may be greater during pump-down than during the rest of the drying cycle. The threshold may alternatively be selected from a table or graph based on a measurement from another sensor. A step count of a programmable logic controller may, for example, be used in determining the current stage of the process cycle, and a threshold is selected for the vacuum pump power consumption based on that determination. In another example, a pressure measurement in the vacuum chamber is used to determine the current stage of the process.

Accelerometers or other vibration sensors mounted on compressors and vacuum pumps provide indicators of friction between internal components. Bearing wear within the compressor, caused by poor oil quality or normal wear over time, will change the frequency and amplitude of the measured vibrations. Coupled with power meters, accelerometers can provide information to avoid unnecessary preventive maintenance. Data analytics methods may automatically be applied to a combination of vibration measurements and power consumption measurements in order to determine thresholds and other parameters that are unique to a particular system.

Example: Product Characteristics Predicting Process or Equipment Failures

Data describing product characteristics such as moisture content or contamination may be used in detecting or predicting a system event such as an equipment failure or a process parameter excursion. In one example, moisture content of the product is measured over time during the process and/or at the conclusion of the process, using an infrared sensor. Specific thresholds and parameters for moisture content that indicate a system event may be different for different freeze drying systems. Those parameters must be learned by the system by analyzing data from that particular system. An abnormally high product moisture content may cause the monitoring technique to examine other data collected during a batch run to determine an underlying equipment or process problem.

Network Architecture

Figure 7:
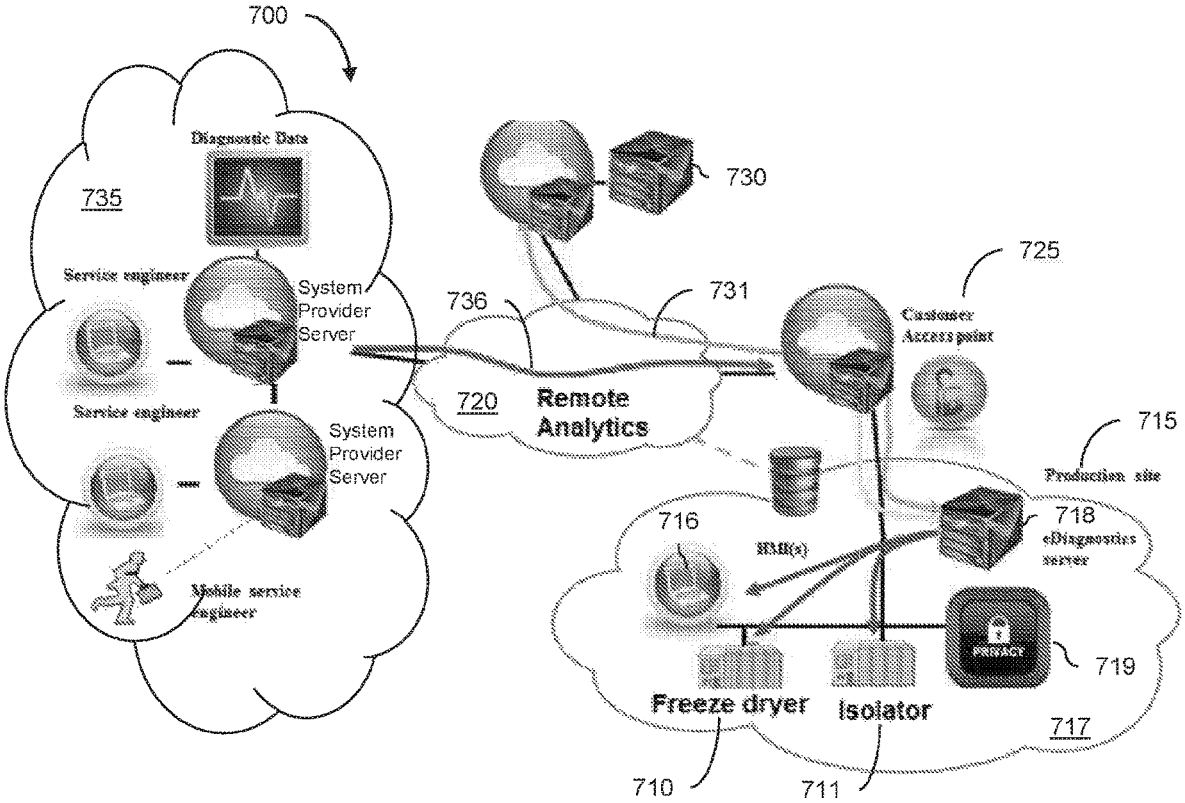
FIG. 7 is an exemplary network architecture of a freeze drying process monitoring system in accordance with an aspect of the disclosure.

An example network architecture 700 for a freeze dryer analysis and monitoring system is shown in FIG. 7. A freeze dryer system 710, together with other related equipment such as an isolator 711, are located at a production location 715 where they are used in manufacturing freeze dried products. A diagnostics server 718 is connected to receive data through a local area network 717 from sensors arranged on the manufacturing equipment 710, 711. The local area network also connects to a human-machine interface (HMI) 716.

The on-site diagnostics server 718, the HMI 716 and the equipment 710, 711 are co-located at the production location 715 and are protected by a firewall and/or other data security system 719. The production location 715 may be a single factory building or may comprise a group of buildings situated at a single production location. The equipment and servers at the production location 715, including the freeze dryer 710, the isolator 711 and the diagnostics server 718, are sufficiently proximate to allow interconnection with a local area network such as an Ethernet network or a WiFi network, without the use of leased commercial telecommunications circuits.

While the production location 715 is shown as having only a single freeze dryer 710 and isolator 711, the site may contain a plurality of freeze drying systems with associated equipment. Each of the freeze drying systems may be connect through the local area network 717 to the on-site diagnostics server 718.

The diagnostics server 718 is connected to an analytics function 720 via a customer access point 725. Multiple diagnostics servers located at one or more customer sites may be connected to a single customer access point 725. The analytics function 720 may be connected to one or more remote servers 730 operated by the same entity that operates the production site 715, or by a third party that provides data analytics services.

The remote servers 730 of the analytics function 720 may be connected through a wide area network such as the Internet to the customer access point 725 via a secure read/write access connection 731 requiring authentication. For example, a virtual private network utilizing a tunneling/encapsulation protocol may be used to connect the analytics function 720 and the customer access point 725 via leased commercial telecommunications circuits. In other embodiments, the analytics function 720 may be performed locally at the production location 715.

The analytics function 720 may additionally or alternatively be connected to an equipment provider service and diagnostic cloud 735. The equipment provider service and diagnostic cloud 735 may be connected to the customer access point via a VPN access connection 736. The equipment provider service and diagnostic cloud may provide predictive maintenance services and diagnostic services to the operators of the production sites based on data received from those sites. Those services may utilize knowledge-based diagnostic tools trained by applying learning algorithms to that data. Production site operators may, for example, choose to allow data from their sites to be used in training diagnostic tools that are available to other production site operators in exchange for the access to those diagnostic tools. A production site operator may alternatively choose to have its data used by the equipment provider service and diagnostic cloud 735 only in diagnostic tools available exclusively to the production site operator, or may choose not to automatically share any data with the equipment provider service and diagnostic cloud 735.

While the production site 715 is shown as having only a single freeze dryer 710 and isolator 711, the site may contain a plurality of freeze drying systems with associated equipment. Each of the freeze drying systems may be connect through the local area network to the on-site diagnostics server 718. As noted above, the freeze drying systems 710, isolators 711, etc. are generally custom designed and vary greatly in specific characteristics such as chamber volume, material handling, etc. The analytics function 720 receives sensor data from those installations as time series that may be annotated to indicate failures, shut-downs, and other significant events. Based on that data, the analytics function 720 may define generic models of the freeze drying equipment to represent correlations between data time series and significant events, and between the time series themselves. Those models define general relationships but are not installation-specific. In particular, the models may not include parameters defining relationships for individual freeze dryer systems. Generic models may alternately or additionally be defined using existing human knowledge of freeze drying systems.

The analytics function may, as noted, be performed by the equipment provider or by a third party. In some instances, the customer operating the production may prefer not to share its data, and may perform the analytics function using its own servers, either remotely or on site.

For the models to be useful in monitoring unique, individual freeze drying systems, the models must be supplemented with parameters describing the unique characteristics of those systems. Those parameters may be learned by the monitoring system after the freeze drying system 710 is installed at the production site 715. In one example, the diagnostics server 718 is initially provided with software for collecting time series data from sensors for each individual freeze drying system, and computing parameters for use in tuning the generic models to describe the individual freeze drying systems. Those parameters are then used in monitoring the systems and in detecting and predicting problems and failures.

The model parameters for monitoring individual freeze dryer systems may be computed on-site by the diagnostics server 718. Alternatively, the measurement data may be transmitted to the analytics function 720 for computation of the model parameters. The process of computing the model parameters may initiate and proceed automatically after installation of the equipment at the production facility. The model parameters may be updated periodically or as needed to take into account changes in the freeze dryer systems.

A freeze drying system is then monitored by receiving time series data from the plurality of sensors associated with the system, and using the system model, as tuned, to predict problems or failures. When a failure or other event is predicted, alerts may be transmitted to the system operators and the system may be placed in a product saving mode.

Figure 8:
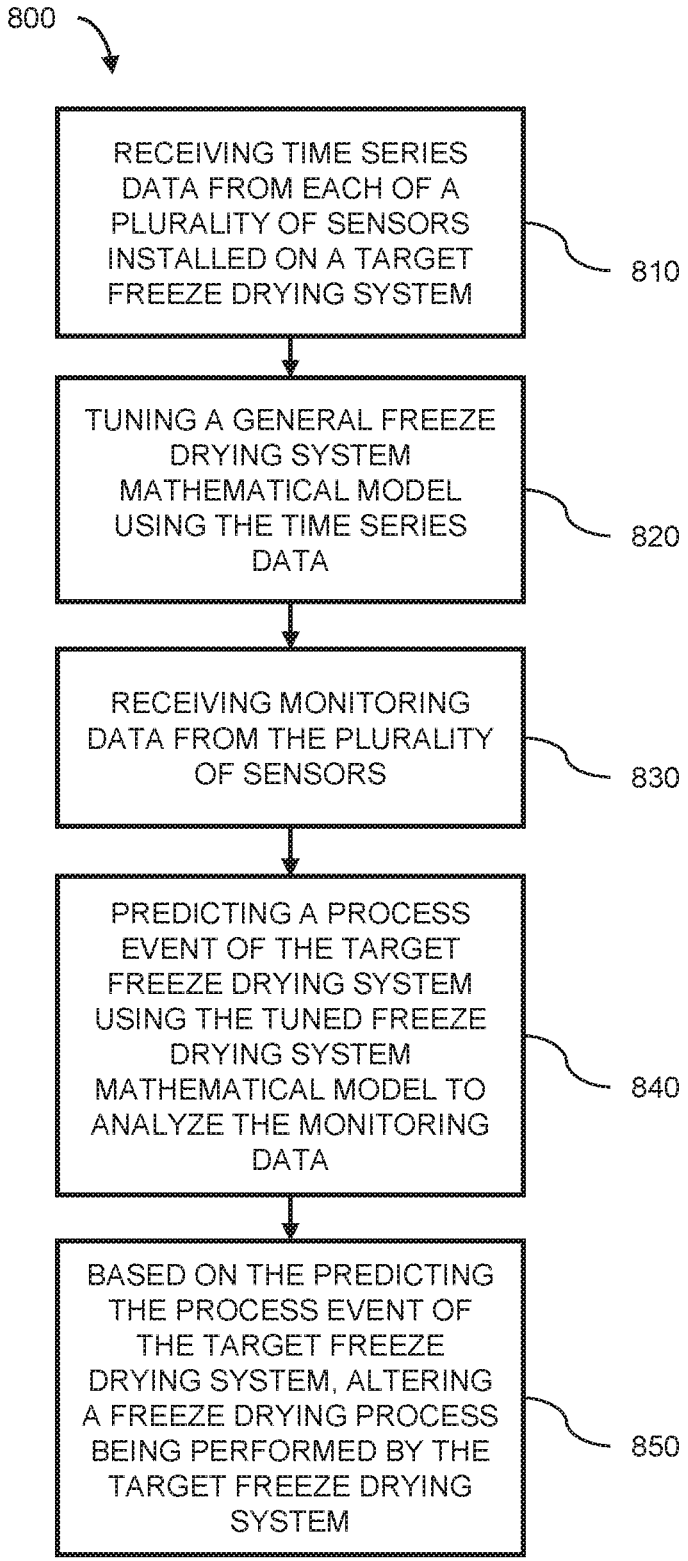
FIG. 8 is a flow chart illustrating a method of monitoring a freeze drying process in accordance with an aspect of the disclosure.

An exemplary method for monitoring a freeze drying system, represented by the diagram 800 of FIG. 8, includes receiving 810 time series data from a plurality of sensors arranged on the target freeze drying system. A general freeze drying system mathematical model is tuned 820 using the time series data to adjust parameters of the general freeze drying system mathematical model to create a tuned freeze drying system mathematical model representing the target freeze drying system.

Monitoring data is received 830 from the plurality of sensors. A system event of the target freeze drying system is predicted 840 using the tuned freeze drying system mathematical model to analyze the monitoring data. Based on the predicting the system event of the target freeze drying system, a freeze drying process being performed by the target freeze drying system is altered 850.

Computer Hardware

Figure 9:
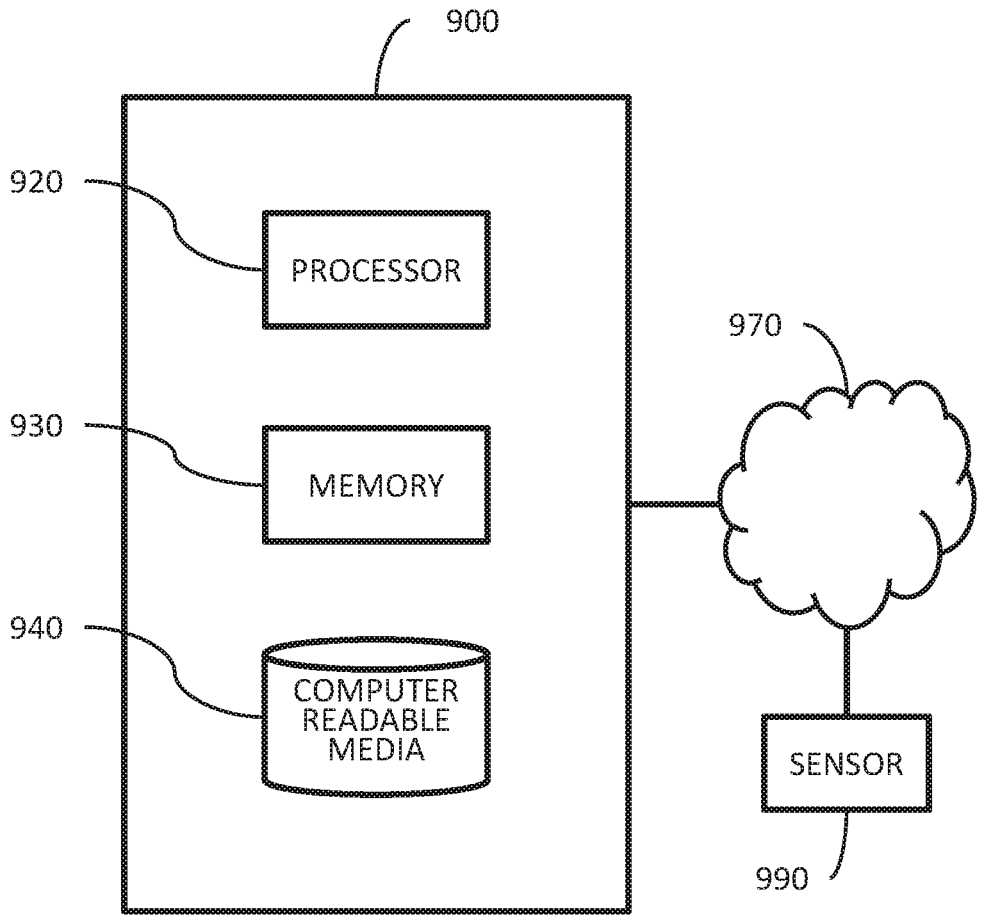
FIG. 9 is a schematic diagram of a computer element in accordance with an aspect of the disclosure.

As shown in FIG. 9, the various network elements and other computer hardware 500 used in implementing the above-described processes and systems comprise one or more processors 520, together with input/output capability for communicating with other network elements and controllers 570 and with sensors 590. Certain network elements also comprise computer readable storage devices 540 having computer readable instructions stored thereon that, when executed by the processors, cause the processors to perform various operations. The processors may be dedicated processors, or may be mainframe computers, desktop or laptop computers or any other device or group of devices capable of processing data. The processors are configured using software according to the present disclosure.

Each of the hardware elements also includes memory 530 that functions as a data memory that stores data used during execution of programs in the processors, and is also used as a program work area. The memory may also function as a program memory for storing a program executed in the processors. The program may reside on any tangible, non-volatile computer-readable storage device as computer readable instructions stored thereon for execution by the processor to perform the operations.

Generally, the processors are configured with program modules that include routines, objects, components, data structures and the like that perform particular tasks or implement particular abstract data types. The term "program" as used herein may connote a single program module or multiple program modules acting in concert. The disclosure may be implemented on a variety of types of computers, including personal computers (PCs), hand-held devices, multi-processor systems, microprocessor-based programmable consumer electronics, network PCs, mini-computers, mainframe computers and the like, and may employ a distributed computing environment, where tasks are performed by remote processing devices that are linked through a communications network. In a distributed computing environment, modules may be located in both local and remote memory storage devices.

An exemplary processing module for implementing the methodology above may be stored in a separate memory that is read into a main memory of a processor or a plurality of processors from a computer readable storage device such as a ROM or other type of hard magnetic drive, optical storage, tape or flash memory. In the case of a program stored in a memory media, execution of sequences of instructions in the module causes the processor to perform the process operations described herein. The embodiments of the present disclosure are not limited to any specific combination of hardware and software.

The term "computer-readable medium" as employed herein refers to a tangible, non-transitory machine-encoded medium that provides or participates in providing instructions to one or more processors. For example, a computer-readable medium may be one or more optical or magnetic memory disks, flash drives and cards, a read-only memory or a random access memory such as a DRAM, which typically constitutes the main memory. The terms "tangible media" and "non-transitory media" each exclude transitory signals such as propagated signals, which are not tangible and are not non-transitory. Cached information is considered to be stored on a computer-readable medium. Common expedients of computer-readable media are well-known in the art and need not be described in detail here.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A method for controlling a target freeze drying system having freeze dryer shelves for transferring heat to and from a product to be freeze dried, comprising:

receiving time series data from a plurality of sensors arranged on the target freeze drying system;

tuning a general freeze drying system mathematical model using the time series data to adjust parameters of the general freeze drying system mathematical model to create a tuned freeze drying system mathematical model representing the target freeze drying system;

receiving monitoring data from the plurality of sensors;

predicting a system event of the target freeze drying system using the tuned freeze drying system mathematical model to analyze the monitoring data; and based on the predicting the system event of the target freeze drying system, altering a freeze drying process being performed by the target freeze drying system by changing a temperature of the freeze dryer shelves to change a temperature of the product and place the freeze drying process in a product protection mode.

2. The method according to claim 1, wherein predicting a system event of the target freeze drying system comprises predicting a process deviation within a chamber of the target freeze drying system.

3. The method according to claim 2, wherein the time series data and the monitoring data each comprise pressure measurements within at least a condenser of the target freeze drying system; and wherein predicting a system event of the target freeze drying system comprises using the tuned freeze drying system mathematical model to analyze the pressure measurements to predict a choking condition in the chamber of the target freeze drying system.

4. The method according to claim 2, wherein the time series data and the monitoring data each comprise measurements of an opening of a bleed valve for controlling a freeze drying chamber pressure of the target freeze drying system; and wherein predicting a system event of the target freeze drying system comprises using the tuned freeze drying system mathematical model to analyze the measurements of the opening to predict a choking condition in the chamber of the target freeze drying system.

5. The method according to claim 2, wherein the time series data and the monitoring data each comprise thermal-conductivity-type pressure measurements of a freeze drying chamber pressure of the target freeze drying system, and further comprise capacitance manometer pressure measurements of the freeze drying chamber pressure; and wherein predicting a system event of the target freeze drying system comprises using the tuned freeze drying system mathematical model to analyze the thermal-conductivity-type pressure measurements and the capacitance manometer pressure measurements to detect a cycle end-point of the target freeze drying system.

6. The method according to claim 1, wherein predicting a system event of the target freeze drying system comprises predicting a failure of equipment of the target freeze drying system.

7. The method according to claim 6, wherein the time series data and the monitoring data each comprise vacuum pump-down time measurements for a freeze drying chamber of the target freeze drying system; and wherein predicting a system event of the target freeze drying system comprises using the tuned freeze drying system mathematical model to analyze the vacuum pump-down time measurements to predict a vacuum pump failure.

8. The method according to claim 6, wherein the time series data and the monitoring data each comprise power consumption measurements for a refrigeration system compressor of the target freeze drying system; and wherein predicting a system event of the target freeze drying system comprises using the tuned freeze drying system mathematical model to analyze the power consumption measurements to detect a deterioration in a quality of oil used in the refrigeration system or to detect wear of a refrigeration system component.

9. The method according to claim 6, wherein the time series data and the monitoring data each comprise temperature and/or pressure measurements for a refrigeration system compressor of the target freeze drying system; and wherein predicting a system event of the target freeze drying system comprises using the tuned freeze drying system mathematical model to analyze the temperature and/or pressure measurements to detect a low level of refrigerant used in the refrigeration system.

10. The method according to claim 1, wherein the time series data and the monitoring data each comprise measurements of a freeze dried product of the target freeze drying system.

11. The method according to claim 10, wherein the time series data and the monitoring data each comprise moisture content measurements of a product of the target freeze drying system; and wherein predicting a system event of the target freeze drying system comprises using the tuned freeze drying system mathematical model to analyze the moisture content measurements to predict a system event comprising an equipment failure or a process parameter deviation.

12. The method according to claim 1, wherein predicting a system event of the target freeze drying system comprises predicting a failure of the target freeze drying system; and wherein altering the freeze drying process being performed by the target freeze drying system comprises placing the target freeze drying system in a product saving mode in which the freeze drying process is suspended and a product is maintained in a usable state.

13. The method according to claim 1, further comprising creating the general freeze drying system mathematical model by receiving time series data from a plurality of freeze drying systems; and performing a regression analysis or a data correlation analysis of the time series data to determine relationships between data from a plurality of sensors.

14. The method according to claim 1, wherein the tuning the general freeze drying system mathematical model uses a time function of the time series data; and wherein the predicting the system event uses a time function of the monitoring data.

15. The method according to claim 1, wherein the tuning the general freeze drying system mathematical model uses a combination of the time series data from two or more of the sensors; and wherein the predicting the system event uses a combination of the monitoring data from two or more of the sensors.

16. The method according to claim 1, wherein the tuning the general freeze drying system mathematical model is performed remotely from the target freeze drying system.

17. A monitoring system, comprising:

a first diagnostics server (718) connected for receiving time series data through a local area network (717) from a plurality of sensors arranged on a first freeze drying system (710, 711) having freeze dryer shelves for transferring heat to and from a product to be freeze dried, the first diagnostics server and the first freeze drying system being co-located in a first production location (715), the first diagnostics server comprising a processor and a computer readable storage device having computer readable instructions stored thereon that, when executed by the processor, cause the first diagnostics server to perform the following operations:

receiving a first sequence of time series data from the plurality of sensors through the local area network;

providing the first sequence of time series data to a data analytics function for tuning a general freeze drying system mathematical model by adjusting parameters of the general freeze drying system mathematical model to create a tuned freeze drying system mathematical model representing the first freeze drying system;

receiving a second sequence of time series data from the plurality of sensors through the local area network;

predicting a system event of the first freeze drying system using the tuned freeze drying system mathematical model to analyze the second sequence of time series data; and based on the predicting the system event of the first freeze drying system, altering a freeze drying process being performed by the first freeze drying system by changing a temperature of the freeze dryer shelves to change a temperature of the product and place the freeze drying process in a product protection mode.

18. The monitoring system of claim 17, further comprising:

an analytics server (530) connected for secure communication through a wide area network with the first diagnostics server, the analytics server additionally being connected for secure communication through the wide area network with a second diagnostics server co-located with a second freeze drying system in a second production location, the analytics server comprising a processor and a computer readable storage device having computer readable instructions stored thereon that, when executed by the processor, cause the analytics server to perform the following operations:

receiving time series data from a plurality of sensors arranged on the second freeze drying system; and creating the general freeze drying system mathematical model by performing a regression analysis or a data correlation analysis of the time series data to determine relationships between data from the plurality of sensors arranged on the second freeze drying system.

19. The monitoring system of claim 18, wherein the analytics server additionally performs the data analytics function for tuning the general freeze drying system mathematical model.

20. The monitoring system of claim 18, wherein the analytics server is connected through the wide area network with the first diagnostics server and the second diagnostics server via one or more virtual private networks.

21. The monitoring system of claim 17, further comprising:

an equipment provider service and diagnostic cloud (535) connected for secure communication through a wide area network with the first diagnostics server, the equipment provider service and diagnostic cloud additionally being connected for secure communication through the wide area network with a second diagnostics server co-located with a second freeze drying system in a second production location, the equipment provider service and diagnostic cloud comprising a processor and a computer readable storage device having computer readable instructions stored thereon that, when executed by the processor, cause the analytics server to perform the following operations:

receiving time series data from a plurality of sensors arranged on the first and second freeze drying systems;

applying learning algorithms to the time series data to enhance diagnostic tools; and providing predictive maintenance and diagnostic services to the operator of the first production sites using the diagnostic tools.

22. The monitoring system of claim 17, wherein the analytics server is operated by a same entity that operates the first production location.

23. The monitoring system of claim 17, wherein the analytics server is operated by a provider of the first freeze drying system.

24. The monitoring system of claim 17, wherein the first and second sequences of time series data each comprise pressure measurements within a chamber of the first freeze drying system; and wherein predicting a system event of the first freeze drying system comprises using the tuned freeze drying system mathematical model to analyze the pressure measurements to predict a choking condition of the first freeze drying system.

25. The monitoring system of claim 17, wherein the first and second sequences of time series data each comprise measurements of an opening of a bleed valve for controlling a freeze drying chamber pressure of the first freeze drying system; and wherein predicting a system event of the first freeze drying system comprises using the tuned freeze drying system mathematical model to analyze the measurements of the opening to predict a choking condition of the first freeze drying system.

26. The monitoring system of claim 17, wherein the first and second sequences of time series data each comprise thermal-conductivity-type pressure measurements of a freeze drying chamber pressure of the first freeze drying system, and further comprise capacitance manometer pressure measurements of the freeze drying chamber; and wherein predicting a system event of the first freeze drying system comprises using the tuned freeze drying system mathematical model to analyze the thermal-conductivity-type pressure measurements and the capacitance manometer pressure measurements to detect a cycle end-point of the first freeze drying system.

27. The monitoring system of claim 17, wherein the first and second sequences of time series data each comprise vacuum pump-down time measurements for a freeze drying chamber of the first freeze drying system; and wherein predicting a system event of the first freeze drying system comprises using the tuned freeze drying system mathematical model to analyze the vacuum pump-down time measurements to predict a vacuum pump failure.

* * * * *